US009233412B2

(12) United States Patent
Huetter

(10) Patent No.: US 9,233,412 B2
(45) Date of Patent: Jan. 12, 2016

(54) METHOD FOR FORMING A PIPE SECTION

(75) Inventor: Werner Huetter, Ahlen (DE)

(73) Assignee: Leifeld Metal Spinning AG, Ahlen (DE)

( * ) Notice: Subject to any disclaimer, the term of this patent is extended or adjusted under 35 U.S.C. 154(b) by 199 days.

(21) Appl. No.: 13/992,214

(22) PCT Filed: Nov. 14, 2011

(86) PCT No.: PCT/EP2011/005734

§ 371 (c)(1),
(2), (4) Date: Jun. 6, 2013

(87) PCT Pub. No.: WO2012/076111

PCT Pub. Date: Jun. 14, 2012

(65) Prior Publication Data

US 2013/0247635 A1 Sep. 26, 2013

(30) Foreign Application Priority Data

Dec. 7, 2010 (DE) ..... 10 2010 053 634

(51) Int. Cl.
*B21D 51/24* (2006.01)
*B21D 22/18* (2006.01)
*B21D 41/04* (2006.01)

(52) U.S. Cl.
CPC ..... *B21D 51/24* (2013.01); *B21D 22/185* (2013.01); *B21D 41/045* (2013.01)

(58) Field of Classification Search
CPC ..... B21D 22/14; B21D 22/16; B21D 22/18; B21D 22/185; B21D 35/001; B21D 41/04; B21D 41/045; B21D 51/24; Y10T 29/49394
See application file for complete search history.

(56) References Cited

U.S. PATENT DOCUMENTS 2,030,818 A 2/1936 Harter
2,408,596 A * 10/1946 Bednar et al. ..... 72/69

(Continued)

FOREIGN PATENT DOCUMENTS

AT 006938 U1 6/2004
CN 1836834 A 9/2006

(Continued)

OTHER PUBLICATIONS

The International Preliminary Report on Patentability and the English translation of the Written Opinion of the International Searching Authority dated Jun. 12, 2013, which corresponds to International Application No. PCT/EP2011/005734 and is related to U.S. Appl. No. 13/992,214.

(Continued)

*Primary Examiner* — Teresa M Ekiert
(74) *Attorney, Agent, or Firm* — Studebaker & Brackett PC

(57) ABSTRACT

The invention relates to a process for forming a pipe portion, in which process a base having an opening and having an inwardly projecting collar is formed. It is provided that the pipe portion is made to rotate, that the pipe portion is drawn in by means of a forming roller, with the base being formed by the drawing-in process, that an inwardly projecting material thickening is formed integrally in the base and that an opening is made in the base in the region of the inwardly projecting material thickening, wherein the inwardly projecting collar is formed by at least part of the inwardly projecting material thickening. Furthermore, the invention relates to an apparatus for forming a workpiece.

14 Claims, 8 Drawing Sheets

(56) References Cited

U.S. PATENT DOCUMENTS

| | | | | |
|---|---|---|---|---|
| 4,077,100 | A * | 3/1978 | Zahid | 29/890.06 |
| 2003/0046803 | A1 | 3/2003 | Kaneko | |
| 2010/0011830 | A1 | 1/2010 | Huetter et al. | |

FOREIGN PATENT DOCUMENTS

| | | | |
|---|---|---|---|
| CN | 1887473 | A | 1/2007 |
| CN | 101391372 | A | 3/2009 |
| CN | 101528376 | A | 9/2009 |
| DE | 3321363 | A1 | 12/1984 |
| DE | 19607010 | C1 | 12/1996 |
| DE | 102006039656 | A1 | 2/2008 |
| EP | 1886741 | A1 | 2/2008 |
| WO | 02/020192 | A3 | 7/2002 |

OTHER PUBLICATIONS

International Search Report; PCT/EP2011/005734; May 7, 2012.

* cited by examiner

METHOD FOR FORMING A PIPE SECTION

The invention relates to a method for producing a pipe-shaped container, in which a base with an opening and with an inward-projecting collar is provided. Furthermore, the invention relates to a device for forming a workpiece, in particular a pipe section.

The generic device comprises a machine bed with a longitudinal axis, a work spindle, arranged along the longitudinal axis and capable of being driven in a rotating manner, which is designed as a hollow shaft for accommodating the workpiece, a forming roller for forming the workpiece, wherein the forming roller is movable along the longitudinal axis and along a transverse axis and rotatable about a pivot axis.

A generic method and a generic device can be employed, in particular, in the production of containers, especially pressure containers. In this process, a container base with an inward-projecting collar is formed. Through the inward-projecting collar the storage capacity of the container can be enlarged whilst keeping its overall height and overall width respectively.

Containers, especially pressure containers, having one or several outward-projecting collars are widespread. A threaded connection can, for example, be introduced into the collar. A method for producing a pressure container with an outward-projecting collar is described in DE 33 21 363 A1, for example. The production of the base and the collar is carried out by means of a spinning method on a pivoting-form spinning machine. A spinning roller is fed along an arched path to a pipe-shaped workpiece in order to form the container base. Due to a specific shape of the spinning roller an outward-projecting bottleneck is formed at the end of the feeding process.

A generic method is described in DE 196 07 010 C1. In this method, an axial end of a workpiece is introduced into a workpiece mounting of a rotatingly driven forming tool and formed through pressing. Through an axial advance movement of the forming tool and/or the workpiece pressure is generated leading to a flow of the material of the workpiece. By means of a pin the flowing material is led inwards so that a collar inverted into the workpiece interior is designed.

The invention is based on the object to improve a generic method and a generic device in such a way that an especially efficient forming of a workpiece for the purpose of providing an inward-projecting collar can be carried out.

In accordance with the invention the object is achieved by a method and by a device recited in the independent claims, respectively. Preferred embodiments of the invention are stated in the respective dependent claims as well as in the subsequent description and in the Figures.

In a first aspect the method according to the invention is characterized in that as basic workpiece a pipe section is set into rotation, the pipe section is necked in by means of a forming roller, wherein the base is provided through the necking-in process, an inward-projecting material thickening is formed into the base and in that in the area of the inward-projecting material thickening an opening is introduced into the base, wherein the inward-projecting collar is provided by at least a part of the inward-projecting material thickening.

A first fundamental idea of the invention resides in the fact that the base with inward-projecting or inverted collar is substantially produced through a necking-in method. According to the invention, for this purpose a pipe section is necked in, i.e. the diameter of the pipe section is reduced by means of a forming roller which can also be referred to as a necking-in roller in particular.

As basic workpiece or preform for the method according to the invention a workpiece with a pipe section is utilized, i.e. a workpiece that is at least in sections of pipe-shaped design. The pipe section of the workpiece to be formed can have a cylindrical shape in particular. However, it is also possible that the pipe section has, at least in sections, a non-cylindrical shape, such as profilings with longitudinal and/or circumferential grooves for example, thickenings or conical and/or curved sections.

A second fundamental idea of the invention resides in the fact that during or after the necking-in process a base with a material thickening or material accumulation projecting into the workpiece interior is formed in order to thereby provide a thickened area of the base or a thickened polar cap. Hence, the base of the workpiece is selectively thickened in a defined area. The base thus provided has a greater wall thickness in an area, in which the opening with the inward-projecting collar is to be provided, as compared to the adjoining areas of the base, with the enlarged wall thickness being provided by a defined material accumulation that is limited to a predetermined area and projects into the interior of the pipe section. The material accumulation or material thickening projecting inwards in the direction of the pipe section provides the material for the collar to be formed.

According to the invention the collar is provided in that an opening is introduced into the material accumulation such that a ring-shaped collar or neck is brought about by the remaining material of the material accumulation.

The base can be an upper or lower base of a pressure container in particular. Accordingly, the invention also relates to a method for producing a container, especially a pressure container, in which a base with an opening and with an inward-projecting collar is provided. The base of the container can be produced by a method for forming a pipe section. In this, provision is made, in particular, in that a remaining part of the pipe section or of the workpiece, which is at least in sections of pipe-shaped design, provides a wall of the container.

In a preferred embodiment of the invention the necking-in process is effected through several pivoting movements of the forming roller along different pivot curves in each case. Thus, the base is formed by several passes of the forming roller and thereby necked in successively. During the pivoting movements of the forming roller, the said roller is repeatedly moved obliquely inwards along curved paths, the radius of which decreases progressively, in the direction of the as yet open end of the pipe section.

In an advantageous embodiment of the invention provision is made for the base to be closed in particular in a gas-tight manner through the necking-in process prior to the introduction of the opening. Hence, through necking-in a workpiece shape with a closed base is initially produced from the pipe section. For this, the forming roller is preferably fed inwards to such an extent, i.e. in the direction of an axis of rotation of the workpiece, and the pipe section is necked in to such an extent that a contact of the material in the area of the axis of rotation is brought about and thus a closed base is provided. During the necking-in process the forming roller is therefore fed radially until a closed base area is provided.

According to the invention it is preferred that after closing the base, the said base is formed in order to provide and/or shape the inward-projecting material thickening. In addition or as an alternative to forming the base after its closure it is also possible to form the material thickening at least partially before closing the base.

A simple possibility of producing the inward-projecting material thickening resides in the fact that in order to provide the inward-projecting material thickening, material is shifted from an external area of the pipe section and/or the base to a central area of the base. An external area is to be understood, in particular, as a radially outward lying area of the pipe section and/or the base. The central area refers, in particular, to an area of the base located around an axis of rotation of the pipe section or workpiece. The shifting of the material can be effected, in particular, by advancing the forming roller in an arched manner.

By preference, the inward-projecting frustoconical material thickening is produced at least partially during the necking-in process. For this purpose, provision is made in particular in that the pivot curves, along which the forming roller is moved for necking-in, are adapted such that a desired shape with a predetermined wall thickness profile of the base is attained.

The inward-projecting material thickening can be produced in an especially advantageous manner in that initially an outward-projecting material thickening is formed and subsequently the outward-projecting material thickening is formed into the inward-projecting material thickening. The outward-projecting material thickening can be produced in a simple manner through an appropriate choice of the pivot curves of the forming roller. Subsequently, the outward-projecting material thickening can be converted through forming into an inward-projecting material thickening.

Advantageously, the outward-projecting material thickening is produced at least partially as early as during the necking-in process. This can be accomplished by a suitable shape of the pivot curves, along which the forming roller is moved for necking-in. In particular, the pivot curves can be designed such that a pivot radius of the forming roller is increased in the area of the material accumulation to be formed.

The forming of the outward-projecting material thickening into the inward-projecting material thickening can be effected in an advantageous manner through an axial feeding of a forming tool. Basically, the forming tool can be a tool differing from the forming roller. However, it is particularly preferred if the forming roller, with which the necking-in process is also carried out, is used as a forming tool. This proves to be an especially efficient method. The said forming roller is fed axially, causing material of the base to flow axially inwards so that the inward-projecting frustoconical material thickening is provided which has a thickness in the axial direction that corresponds at least to the twofold, fourfold or fivefold amount of the original wall thickness.

Moreover, it is preferred that for the accumulation of material in the area of the inward-projecting material thickening the base is pre-stamped from the outside. Such a pre-stamping can be effected, in particular, by impressing material from outside, for example by means of a lance, especially a frustoconical lance. In this process, a depression is developed externally on the base in the pre-stamped area and material is shifted into the interior of the workpiece, pipe section or container. Through pre-stamping a particularly selective accumulation of the material can be brought about.

After pre-stamping it can be advantageous to heat the pre-stamped area in order to ensure that during further shifting of material into the pre-stamping or depression a gas-tight base with a homogeneous structure is maintained. During the further forming, further material is shifted into the area of the pre-stamping and in doing so the previously developed depression is closed with material.

According to the invention, a particularly precise forming can be achieved in that during the forming process the forming roller is positioned perpendicularly to a contour of the workpiece or pipe section to be formed. By preference, the forming roller has a cylindrical upsetting geometry which engages with the workpiece contour during forming. To avoid crease formation the forming movements and the roller geometry of the forming roller are designed such that the forming process is substantially carried out solely under compressive stress with a minimum of tensile stress.

In a preferred embodiment of the invention provision is made for the opening to be introduced by means of a cutting method, in particular through drilling and/or milling.

In another preferred embodiment the opening is produced through thermal cutting, as for example piercing by means of a cutting or welding torch.

It is especially preferred if the introduction of the opening gives rise to a further accumulation of material in the interior of the pipe section or the container. To this end, it is preferred that the opening is introduced through impression, for instance by means of a lance, or through displacement drilling. Through impression or displacement drilling, which can also be referred to as flow drilling or twist drilling, material of the inward-projecting material thickening is displaced radially outwards, whereby the collar is enlarged and stabilized.

It can also be advantageous if a depression is introduced initially into the base, for instance through impression by means of a frustoconical lance, and if, in a further method step, the depression is opened through mechanical processing, as for example drilling. This embodiment is especially advantageous in combination with the pre-stamping of the thickened area of the base.

Preferably, the forming process takes place in a heated state, in particular at approximately 900 to 1000° C. The heating can be effected either on the forming machine itself, for example by a gas torch or through induction, or outside the forming machine, for example by a heating oven or through induction. By preference, the temperature of the workpiece is determined during forming by a temperature measuring device and possible heat losses are compensated by a heat supply means, more particularly a gas torch.

In a second aspect the method according to the invention is characterized in that as basic workpiece a circular blank, on which the collar with the opening is designed, is set into rotation and in that for the purpose of providing a pipe section an outer circumference of the circular blank is formed axially against a spinning chuck towards a side, to which the collar is directed.

Here, a first fundamental idea resides in the fact that the production of the collar takes place before the production of the pipe section. It is therefore possible, quite easily, to form a pipe-shaped workpiece with an inward-directed collar from a circular blank, on which a hub-shaped collar or neck has been formed in a first step.

A second fundamental idea can be seen in the fact that the outer circumference of the circular blank is not formed in a manner facing away from the collar or neck but rather in the direction of the collar or neck so that an inward-directed, pipe-shaped collar of a pipe-shaped container is provided.

In a preferred embodiment the collar is designed on the circular blank through flow forming. The production of the collar through spinning/flow forming proves to be an efficient method.

The circular blank can preferably be a sheet metal blank.

To carry out the method it is preferred that a device for forming a workpiece is used, which has spinning chuck with an axial recess for the collar. The collar can be introduced into the recess of the spinning chuck and the workpiece can then be formed on the spinning chuck by means of a forming roller.

A particularly efficient production of a container with two open bases, i.e. two bases on which an inward-projecting collar is present, can be achieved by a combination of the method according to any one of claims with the particular feature of providing the pipe section a circular blank is used, on which a further collar with a further opening is designed, and setting the circular blank into rotation and, for the purpose of providing the pipe section, an outer circumference of the circular blank is formed axially against a spinning chuck towards a side, to which the further collar is directed and/or the feature of designing the collar on the circular blank through spinning/flow forming. With the aforementioned features, it is possible to initially produce from a circular blank with a collar pipe-shaped body with a first base and an inward-projecting collar. The shaping of the second base can then be effected.

The device according to the invention is characterized in that a hole producing tool is provided in order to introduce an opening along the longitudinal axis into the workpiece while the said workpiece is clamped. The production of the opening, which can be a hole or also a depression in particular, can therefore take place in the same setting as the necking-in process.

In the case of the device according to the invention it is preferred that the forming roller is supported such that through a translational movement of the forming roller along the longitudinal axis a forming force can be applied to a material thickening of the workpiece arranged in the area of the longitudinal axis. For this purpose, a longitudinal support can be provided in particular, which is supported in a displaceable manner along the longitudinal axis and on which the forming roller is supported directly or indirectly. For the application of the forming force it is advantageous if the advance force is introduced symmetrically to the longitudinal axis into the longitudinal support.

In the following the invention is described further by way of preferred embodiments shown schematically in the accompanying drawings, wherein shows:

FIG. 1 a schematic illustration of a necking-in process of a pipe-shaped workpiece;

FIG. 2 a schematic illustration of a necking-in process of a pipe-shaped workpiece with thickened opening wall;

FIG. 3 a device for carrying out the method according to the invention;

FIGS. 4*a* to 4*h* a first embodiment of the method according to the invention;

FIGS. 5*a* to 5*e* a second embodiment of the method according to the invention;

FIGS. 6*a* to 6*f* a third embodiment of the method according to the invention;

FIGS. 7*a* to 7*e* a fourth embodiment of the method according to the invention;

FIG. 8 a forming roller during the forming process;

FIG. 9 a first container produced according to the method pursuant to the invention;

FIG. 10 a section of a further container produced according to the method pursuant to the invention and FIG. 11 a further embodiment of a device according to the invention and the method according to the invention.

FIGS. 1 and 2 show an embodiment of the method according to the invention by way of the example of a necking-in process for the production of a base 18 or a polar cap for a container 28, in particular a pressure container. As basic workpiece use is made of a workpiece 10 with a pipe section 12 in each case. The workpiece 10 can be a welded or seamless pipe for example. It is also possible that in a preceding work step the workpiece 10 is produced from a circular blank, for instance through spinning/flow forming. The workpiece 10 preferably contains a metal, especially stainless steel.

The pipe section 12 of the workpiece 10 has a length section 14 that is to be formed into a base 18. The length section 14 or pipe section 12 concerned is an axial end section of the workpiece 10 in particular.

The workpiece 10, which can also be referred to as a preform, is formed or necked in using a forming roller 52, in particular a necking-in roller. To this end, the workpiece 10 with the pipe section 12 is driven in a rotating manner about an axis of rotation 11. The forming of the workpiece 10 then takes place while the workpiece 10 is rotating. Basically, instead of the one forming roller 52 use can also be made of several forming rollers.

The forming of the length section 14 into the base 18 takes place in several passes of the forming roller 52 carried out in succession. In this process, the cylindrical length section 14 is formed by the forming roller 52 towards smaller diameters, i.e. a workpiece contour with a decreasing diameter in the axial direction and an increasing wall thickness in the axial and/or radial direction is produced. The movement of the forming roller 52 is such that a desired profile of the length section 14 or the base 18 is brought about. The length section 14 of the pipe section 12 is formed to such an extent that the base 18 is closed completely and, in particular, in a gas-tight manner.

Before, during and/or after closing the base 18 a material thickening 22 is formed on the base 18. The material thickening 22 is formed such that an inward-projecting material thickening 24 is provided. A locally thickened base section is developed in the area of the axis of rotation 11. After the material thickening 22, 24 has been formed an opening 20 is introduced into the thickened area of the base 18.

In FIG. 1 the forming process is shown by way of the example of a pipe having a constant wall thickness in the area of the length section 14 to be formed. The pipe can be a welded or also a seamless pipe. FIG. 2 shows the forming of a workpiece 10 that has a thickened opening wall, i.e. a thickened length section 15. Due to the thickened length section 15 additional material is made available for providing the base 18 and the material thickening 22 in particular. In addition to the thickened area 15 with a constant wall thickness the length section 14 has a transition area 16 with a transition slant.

To implement the method use can be made of a forming device or forming machine 40, more particularly a necking-in machine, as illustrated in FIG. 3. The forming machine 40 comprises a machine bed 42, which is preferably designed as an inclined bed. The forming machine 40 furthermore comprises a headstock 44, in which a work spindle 46 is supported in a rotatable manner about a longitudinal or machine axis 47. The work spindle 46 can be driven in a rotating manner by means of a spindle drive 48 and is designed as a hollow shaft in order to accommodate the workpiece 10 inside it. To clamp the workpiece 10 a clamping chuck 50 is arranged on the work spindle 46.

For the forming of the workpiece 10 the forming machine 40 has a forming roller 52 which is supported in a rotatable manner about an axis of rotation 53. The forming roller 52 is supported on the machine bed 42 in such a manner that a translational movement along the longitudinal axis 47, a translational movement along a transverse axis 63 and a pivoting movement 30 about a pivot axis 65 is possible. For this purpose, the forming roller 52 is supported on a pivot support 64 which is rotatable about the pivot axis 65. The pivot support 64 is arranged for its part on a longitudinal support 60 which is displaceable along the longitudinal axis 47 of the forming machine 40. In addition, a transverse support 62 is provided which permits a displacement of the forming roller 52 along the transverse axis 63. Moreover, the forming roller 52 is adjustable with the pivot support 64.

The forming roller 52 is supported on a forming housing 54. On the forming housing 54 a heating torch 58 is arranged which is adjustable with the forming housing 54. The forming housing 54 is mounted, in particular, on the pivot support 64. With the heating torch 58 the workpiece 10 can be heated when the forming roller 52 is engaged with the workpiece 10.

As a result of the combination of longitudinal support 60, transverse support 62 and pivot support 64 a movement of the forming roller 52 along any chosen path is rendered possible. The longitudinal support 60 enables a purely translational movement of the forming roller 52 along the longitudinal axis 47. By feeding the forming roller 52 along the longitudinal axis 47, i.e. into an axial direction of movement 32, material can be shifted from an external area of the base 18 into an interior space of the workpiece 10, in particular in order to form an outward-projecting material thickening 23 into an inward-projecting material thickening 24, as described in detail hereinafter.

The forming machine 40 furthermore has a hole producing means 70 that comprises a hole producing tool 72, namely a cutting torch 73. Alternatively, a lance 74 and/or a displacement drill 75 could also be arranged. The hole producing tool 72 is arranged on a pivot arm 78 which is pivotable about a pivot axis 79 so as to pivot the hole producing tool 72 from an idle position into an operating position. The pivoting of the pivot arm 78 can be effected by means of a lifting cylinder 80.

Furthermore, the forming machine 40 comprises a pre-forming means 86 with a forming or pre-forming tool 88 for pre-forming or pre-stamping the workpiece 10. In this example the pre-forming tool 88 is a lance 74, in particular a frustoconical lance. Alternatively, the displacement drill 75 or the lance 74 could be arranged too. The pre-forming tool 88 is movable on a pre-forming support 90 along the longitudinal axis 47 and along the transverse axis 63. By displacing the pre-forming tool 88 along the transverse axis 63 the pre-forming tool 88 can be moved from an idle position into an operating position. Through a movement along the longitudinal axis 47 the pre-forming tool 88 can be fed towards the base 18 of the workpiece 10 in order to pre-form or pre-stamp the base 18 of the workpiece 10.

For the post-processing of the workpiece 10, especially the opening 20, a post-processing tool 92 is provided which can comprise a drill, a bevel cutter, a bevel countersink, a thread cutter and/or a widening tool in particular.

Finally, the forming machine 40 has a temperature measuring device 98 for determining a temperature, in particular a temperature in the area of a forming zone of the workpiece 10. For heating and/or re-heating an already heated-up workpiece 10 a heat supply means is furthermore provided.

To carry out the method the workpiece 10 to be formed is introduced into the work spindle 46 designed as a hollow shaft and clamped by means of the clamping chuck 50. The clamping of the workpiece 10 in the work spindle 46 is effected such that the length section 14 of the workpiece 10 to be formed protrudes from the work spindle 46 and the clamping chuck 50. By preference, an additional axial area located next to the length section 14 to be formed protrudes from the clamping chuck 50. An axial end of the clamping chuck 50 is designated with reference sign 51 in FIGS. 1 and 2.

Further variants and embodiments of the method according to the invention are described in the following with reference to FIGS. 4 to 8 in particular.

A first embodiment of the method according to the invention is illustrated in FIGS. 4*a* to 4*h*. After clamping the workpiece 10 in the work spindle 46 the workpiece 10 is set into rotation about its axis of rotation 11 by means of the spindle drive 48 and formed by means of the forming roller 52. Here, the axis of rotation 11 coincides with the longitudinal axis 47 of the forming machine 40. Through the forming process a gas-tight base 18 is produced.

Before and/or after closing the base 18, further material is shifted from an external area of the pipe section 12 and/or the base 18 in the inward direction towards a central area 19 of the base 18 in order to thicken this area, FIG. 4*a*. The central area 19 is located, in particular, in the area of the axis of rotation 11 of the workpiece 10 or alternatively the longitudinal axis 47 of the forming machine 40. Through the shifting of material in the direction of the axis of rotation 11 and the accumulation of material in the central area 19 an outward-projecting material accumulation or material thickening 23 is provided initially.

In a further method step the outward-projecting material thickening 23 is formed into an inward-projecting material thickening 24. For this, the forming roller 52 is fed axially along the longitudinal axis 47 or the axis of rotation 11. As a result, material is spun into the interior of the container 28 or the pipe section 12, FIG. 4*b*. As illustrated in FIGS. 4*c* to 4*f*, the method steps 4*a* and 4*b* can be repeated until the inward-projecting material thickening 24 has reached a desired volume and/or a desired shape. Thus, the forming and thickening of the base 18 takes place in several necking-in passes.

To ensure a gas-tight closure of the base 18 the said base 18 can be re-heated in-between the individual pivoting movements of the forming roller 52. This can be effected, for example, by way of a heating torch 58 and/or a hole welding torch.

The number of pivoting movements and the degree of feeding after each pivoting movement are preferably preselected in a control. During the final pivoting movements the outer surface of the base 18 can be additionally smoothed and/or a shoulder for a protection cap can be formed.

By preference, the inward-projecting material thickening 24 is opened directly after necking-in and thickening. This can be carried out by means of a hole welding torch for example, FIG. 4*g*. Through the introduction of an opening 20 a ring-shaped, in particular pipe-shaped collar 26 is provided around the opening 20. The collar 26 projects inwards into the workpiece interior or the container interior, hence it is inverted inwards into the workpiece interior or the container interior.

In a further work step the produced opening 20 can be processed mechanically, for example to produce a connection for a valve and/or to introduce a thread into the collar 26, FIG. 4*h*.

Another embodiment of the method according to the invention is shown schematically in FIGS. 5*a* to 5*e*. In contrast to the method shown in FIGS. 4*a* to 4*h* a depression is introduced initially into the material accumulation 22, 24, FIG. 5*d*. The introduction of the depression is carried out by means of a widening tool, in particular a frustoconical lance 74. Through the depression a closed collar 25 is provided initially which is inverted inwards. Afterwards, the depression is drilled open to a through-hole, whereby the opening 20 is produced, FIG. 5*e*. By preference, the production of the depression by means of the frustoconical lance 74 takes place in the same setting as the previous forming process. Through the introduction of the opening 20 the open, inwardly inverted collar 26 is provided.

The frustoconical lance 74 has a frustoconical, axial end section. To produce the depression in the base 18 the frustoconical lance 74 is pressed axially, especially without rotational movement, into the base 18 or the material thickening 22, 24 provided therein. At the axial end of the frustoconical lance 74 a blunt, in particular rounded pressing area is provided.

FIGS. 6*a* to 6*f* show a further method variant of the method according to the invention. Here, the thickened area of the base 18, i.e. the material thickening 22, is pre-stamped in at least one intermediate step during the necking-in process, FIG. 6*c*. Through pre-stamping, effected for example by means of a frustoconical lance, material is shifted into an inner area of the pipe section 12 or the container 28 where it accumulates.

After pre-stamping, further material is shifted into the center of the base 18 and in this way the previously developed pre-stamping is closed with material, FIG. 6*d*. Afterwards, in a further method step analogous to FIG. 5*d*, a funnel-shaped depression is produced e.g. by means of a frustoconical lance, FIG. 6*e*. The funnel-shaped depression provides a closed collar 25 which, in a further method step analogous to FIG. 5*e*, can be opened and processed mechanically, FIG. 6*f*.

Another method variant is shown in FIGS. 7*a* to 7*e*. The opening of the inward-projecting material thickening 24 for providing the inward-projecting collar 26 takes place by means of a hole producing tool 72 in the form of a widening tool, as for example a lance 74, a twist drill and/or a displacement drill 75, FIGS. 7*a* to 7*d*. In displacement drilling the opening 20 is produced in a non-cutting forming process. By means of the displacement drill 75 the produced opening 20 can be widened subsequently through a transverse movement of the displacement drill 75, FIG. 7*d*.

The displacement drill 75 has a conical tip followed by a cylindrical section that determines the diameter of the resultant bore or opening 20. The processed material is not cut by chip removal but displaced by the force of the displacement drill 75 and the developing frictional heat. As a result, the material of the inward-projecting material thickening 24 is displaced radially, thereby providing an especially stable collar 26. Just as in the previously described method variants, the opening 20 can then be processed mechanically.

In an advantageous embodiment the forming roller 52 has one or several forming edges 54 which carry out the actual forming process. Furthermore, it has a forming and guiding section 55 that serves, in particular, for guiding and leading the formed material. During the forming process the forming and guiding section 55 rests in planar fashion against the workpiece contour. When designing the pivoting movements it is advantageous if, during the forming process, the forming roller 52 is positioned perpendicularly on a current workpiece contour, as depicted in FIG. 8. In particular, this means that at least one of the forming sections 54 of the forming roller 52 is positioned perpendicularly on the workpiece contour to be formed. During forming, the forming and guiding section 55 can precede or follow the forming section 54 so that the formed material slides along the forming and guiding section 55.

The forming and guiding section 55 has a substantially plane contact surface that can also be used for the axial shifting of material for forming the outward-projecting material thickening 23 into the inward-projecting material thickening 24.

FIG. 9 shows a container 28, more particularly a pressure container, which is produced according to the method pursuant to the invention. The container 28 has a cylindrical section 29 and a respective base 18 at opposite ends of the cylindrical section 29. The bases 18 have each been produced by means of the method according to the invention and each have an opening 20 with an inward-projecting collar 26. As a result of the production method of the inward-projecting collar 26, the said collar 26 narrows inwards from the base 18 in the axial direction. The bases 18 of the container 28 are each designed as flat bases.

Figure 2:
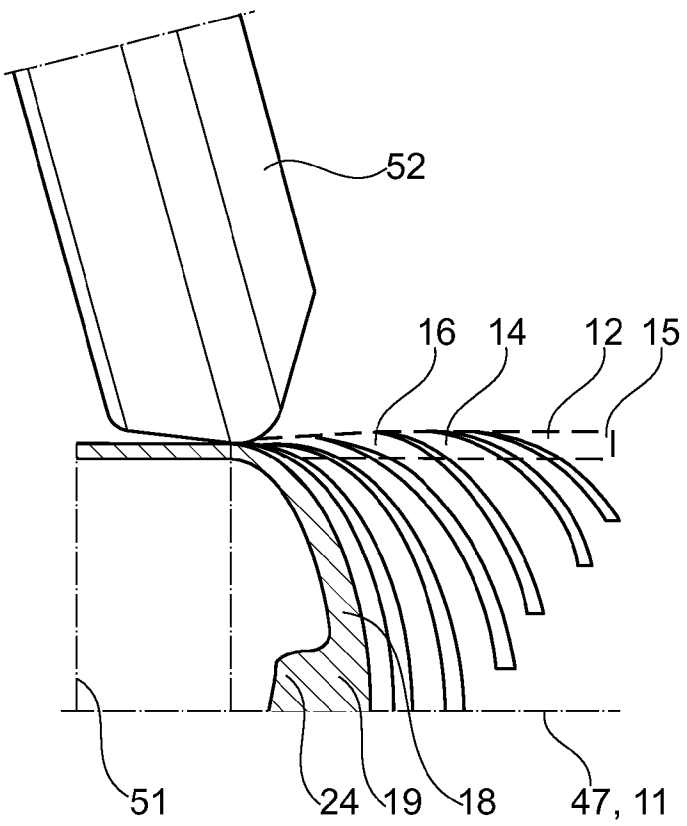
Figure 1:
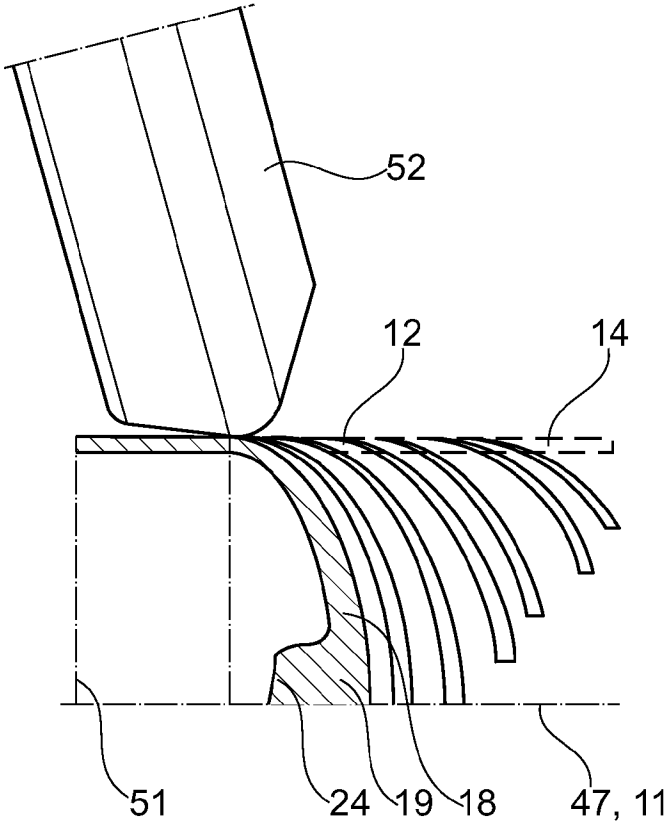
Figure 3:
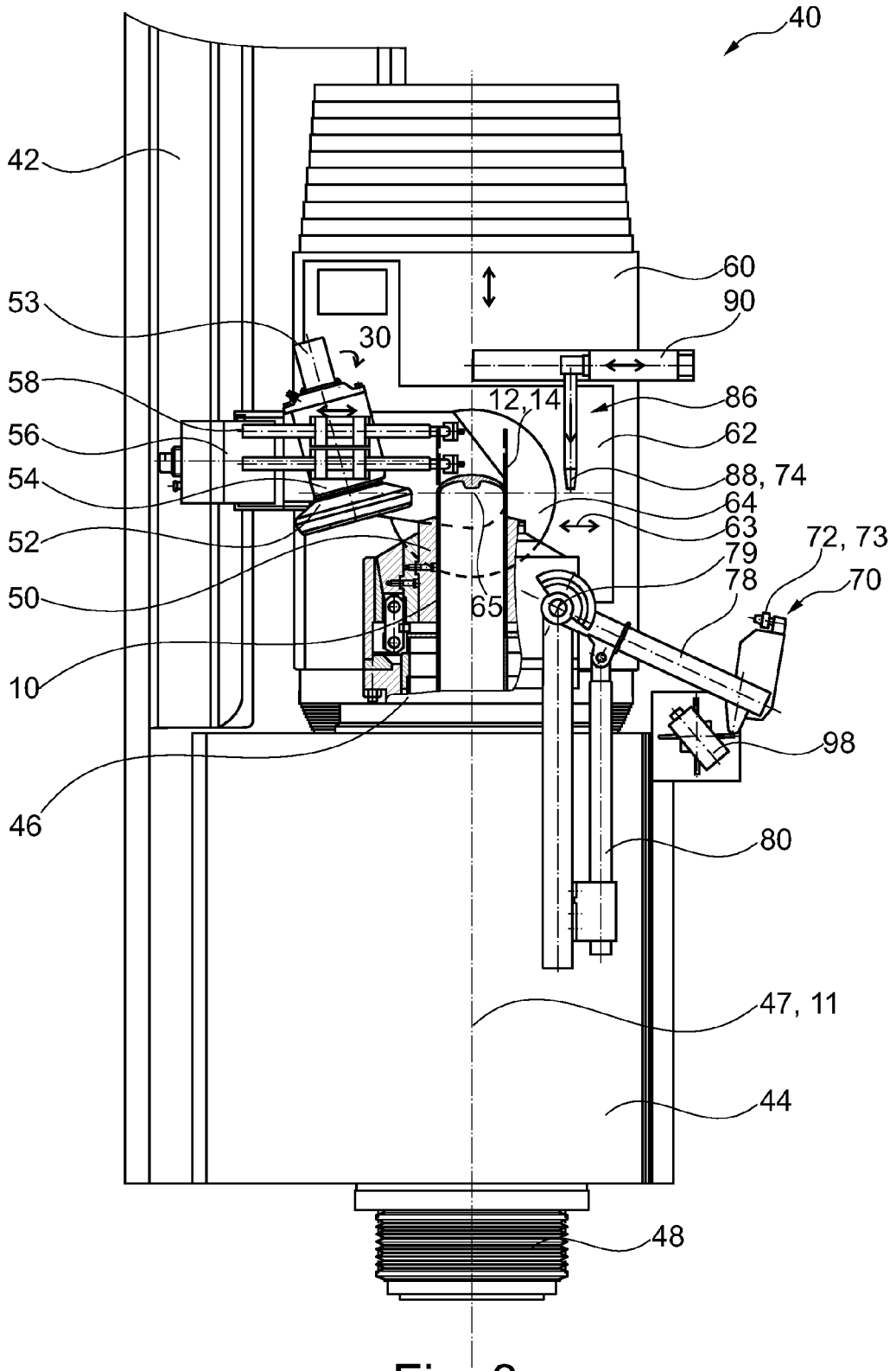
Figure 4:
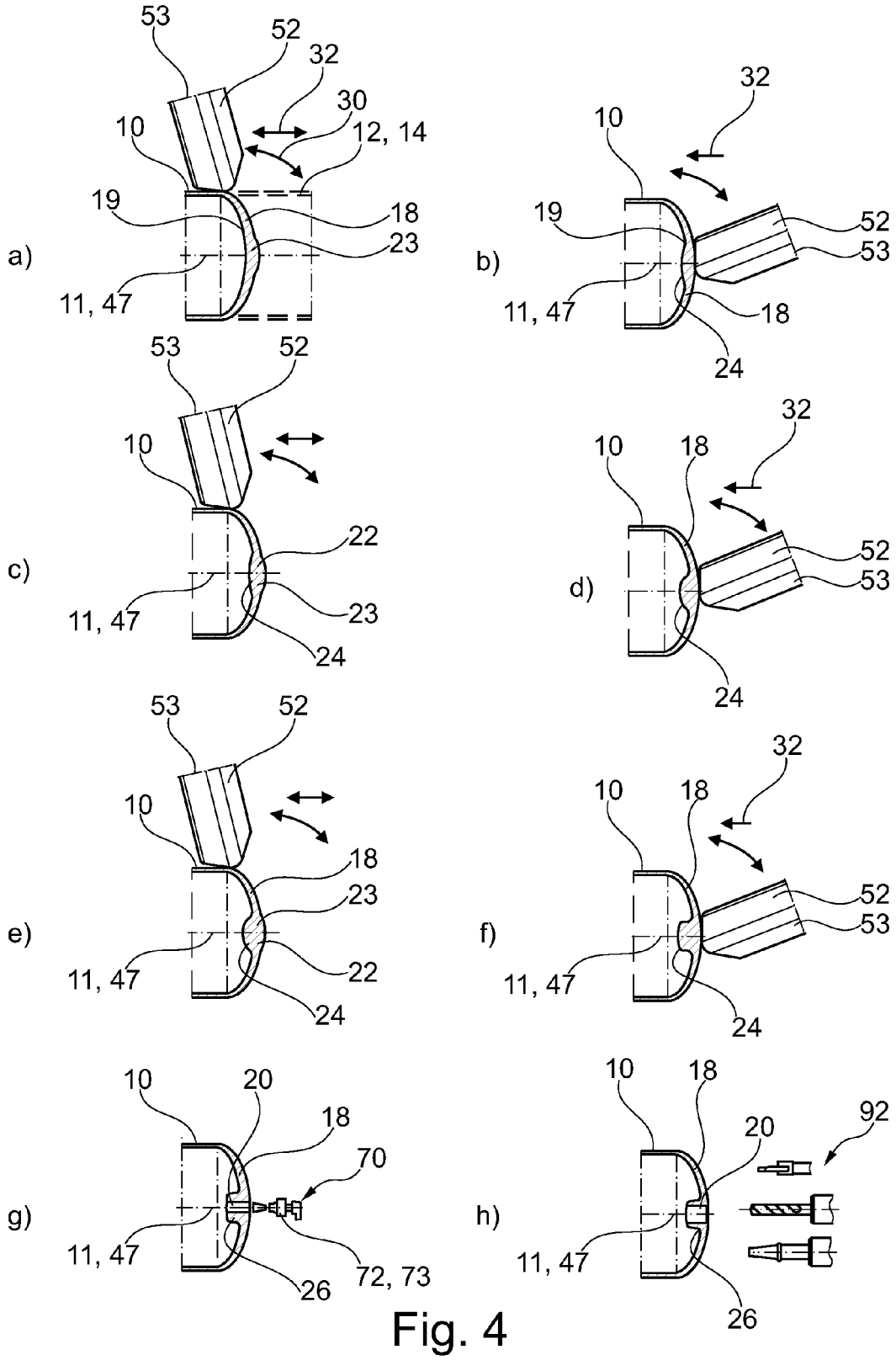
Figure 5:
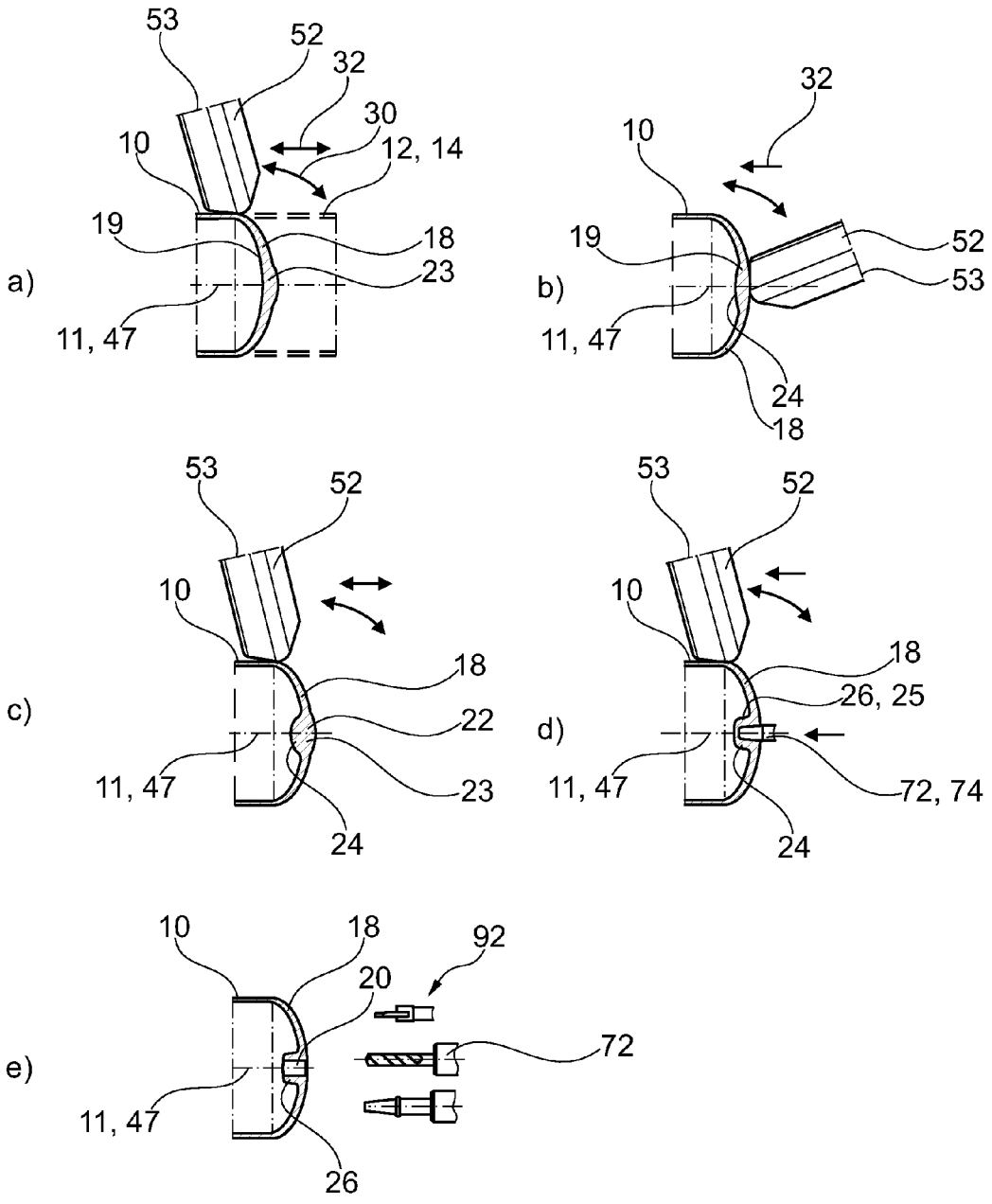
Figure 6:
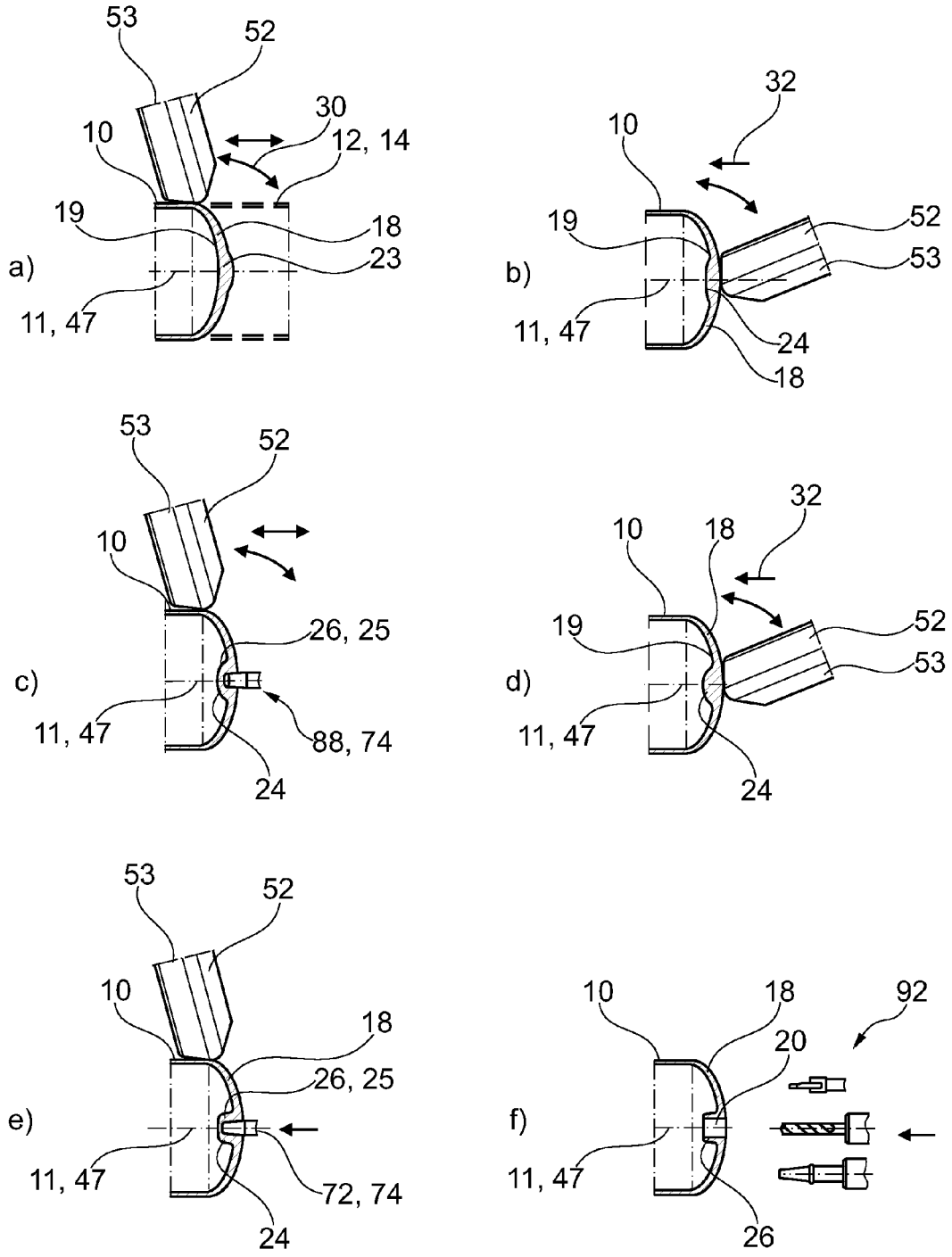
Figure 7:
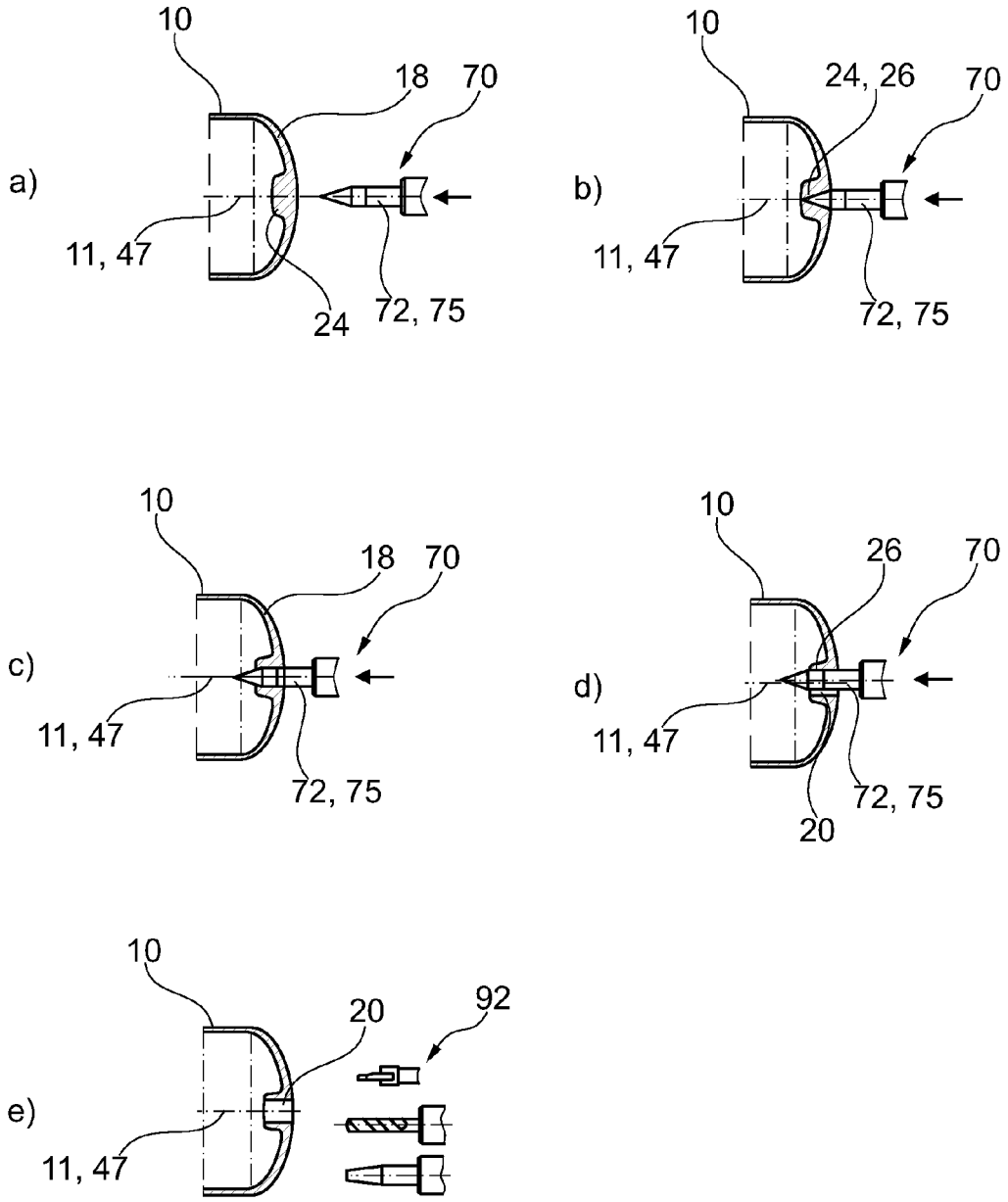
Figure 8:
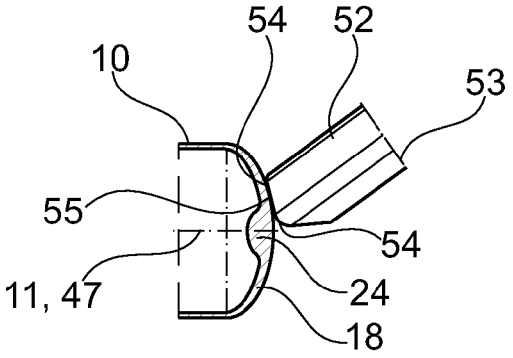
Figure 9:
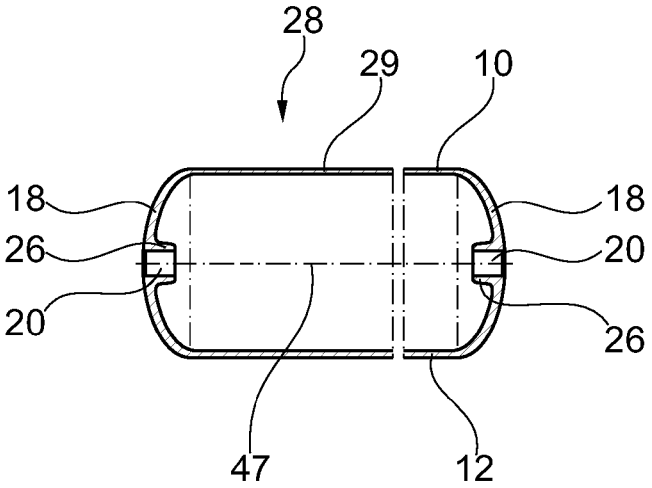
Figure 10:
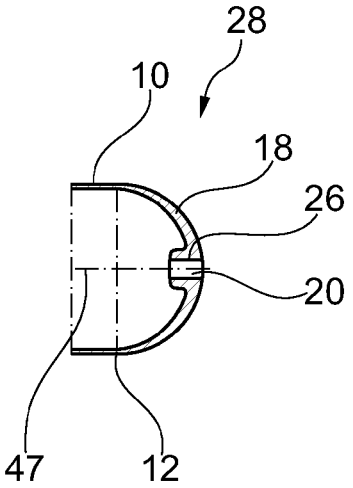
FIG. 10 shows a section of a corresponding container 28 with a circular base. As an alternative to the base shapes illustrated in FIGS. 9 and 10, bases of any other shape can also be produced with the method according to the invention.

The device 40 has a spinning chuck 45 which is of pipe-shaped design and can also be referred to as a spinning mandrel. At one axial end of the spinning chuck 45 a central accommodating opening 38 for the collar 26 of the workpiece 10 in the shape of a circular blank is located.

Furthermore, the device 40 comprises a pressing element 49. The pressing element 49 is supported in an axially movable manner in a housing 36 and serves to press the workpiece 10 axially against the spinning chuck 45, thereby clamping it between spinning chuck 45 and pressing element 49.

The housing 36 is designed as a forming die 37. The forming die 37 is axially movable relative to the spinning chuck 45 and relative to the pressing element 49. Through an axial movement between forming die 37 and spinning mandrel 45 the workpiece 10 can be formed, in particular deep drawn and/or pressed. In this way, a base 18 with a desired contour can be shaped. To this end, the forming die 37 has an axial forming recess 39.

Finally, the device 40 has one or several forming rollers 52 with which, following the deep drawing or pressing process of the base, a cylindrical wall area or pipe section 12 can be formed through flow forming. The forming roller 52 is supported on a roller support 56.

Figure 11:
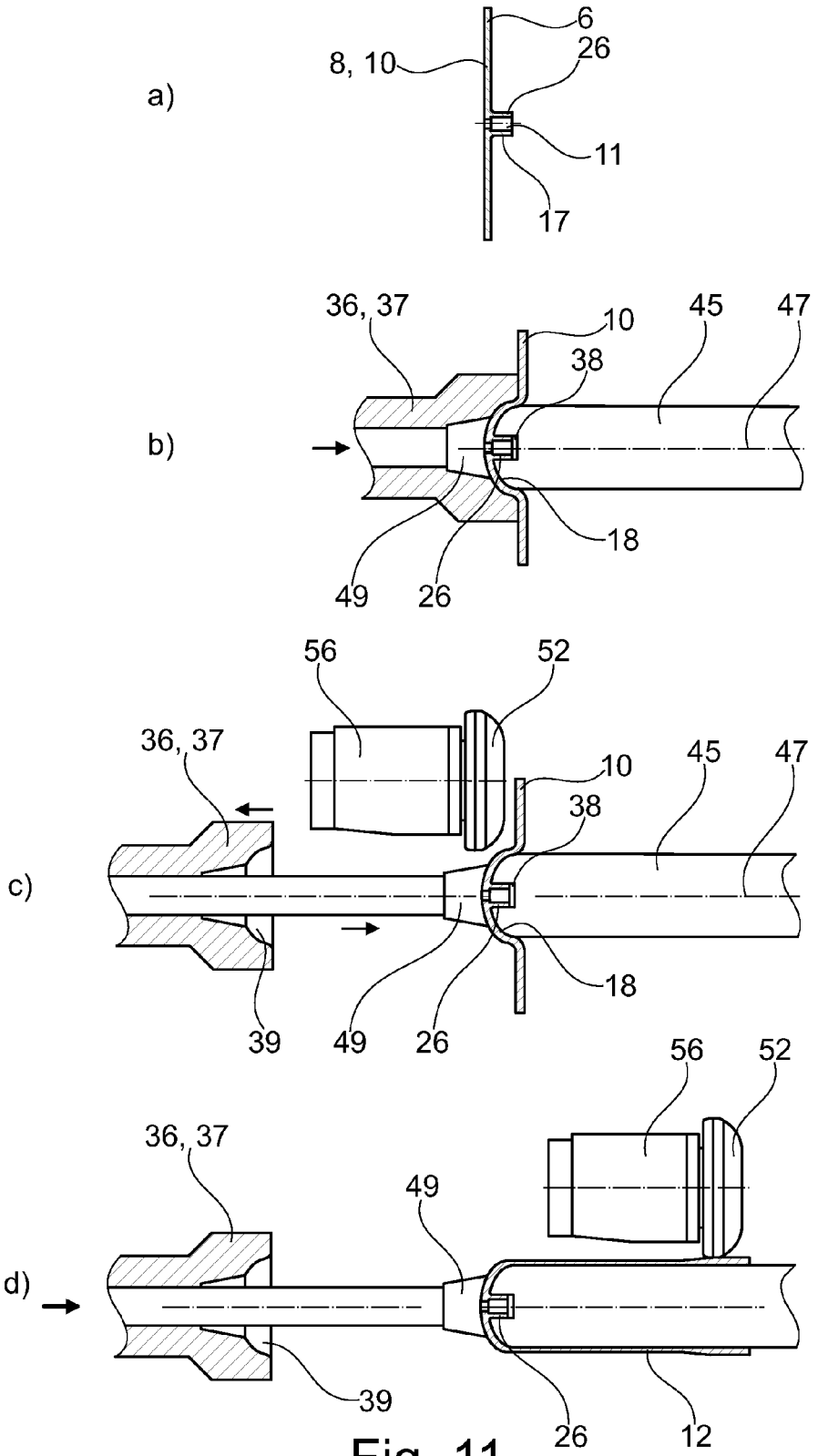
FIG. 11 shows a further embodiment of a forming device 40 according to the invention. The device according to FIG. 11 is especially provided for carrying out the method, in which a circular blank 8 is used as a basic workpiece.

In addition, in FIG. 11 several method steps of an embodiment of the method according to the invention are shown. FIG. 11*a* shows a circular blank 8 or a workpiece 10 in the shape of a circular blank that serves as a basic workpiece. The workpiece 10 comprises a circular-blank-shaped section 6 with an axis of rotation 11. The workpiece 10 furthermore comprises a pipe-shaped section 7 which provides a pipe-shaped collar 26. The collar 26 extends along the axis of rotation 11 of the workpiece 10.

For the production of a pipe-shaped workpiece 10, in particular a container, the workpiece 10 is clamped between the spinning chuck 45 and the pressing element 49 or between the spinning chuck 45 and the forming die 37.

The clamping is effected such that the collar 26 extends in the direction of the spinning chuck 45, projecting in particular into the accommodating opening 38 of the spinning chuck 45.

Through an axial displacement of the forming die 37 relative to the spinning chuck 45 the workpiece 10 in the shape of a circular blank is then preformed or deep drawn, as depicted in FIG. 11 b. In this process, the pressing element 49 can be moved simultaneously with the forming die 37, while the spinning chuck 45 is preferably stationary. Through the pressing element 49 and/or the forming die 37 a base 18 is shaped in a center area of the workpiece 10.

After designing the base 18 the forming die 37 is withdrawn axially from the spinning chuck 45 and thereby removed from the working area, FIG. 11*c*.

The spinning chuck 45, the pressing element 49 and the workpiece 10 are then set into rotation about the longitudinal axis 47. The workpiece 10 is formed with the forming roller 52 and in doing so an external area of the workpiece 10 is formed into a cylindrical shape or a casing area, i.e. the pipe section 12, as depicted in FIG. 11*d*. To this end, the external area of the workpiece 10 is formed towards the collar 26 so that an inward-projecting, pipe-shaped collar 26 is provided which extends substantially parallel to the pipe section 12, i.e. the container wall. For this the forming roller 52 moves along the longitudinal axis 47 in the direction in which the collar 26 extends starting from the base 18.

For an improved forming process a re-heating or intermediate heating can be provided during the processing with the at least one forming roller 52.

The invention claimed is:

1. A method for producing a pipe-shaped container, in which a base with an opening and with an inward-projecting collar is provided, said method comprising the steps of wherein rotating a pipe section of a basic workpiece extending in a longitudinal direction, necking in the pipe section by means of a forming roller such that, the base is formed at the end of the pipe section in the longitudinal direction wherein the base projects along the longitudinal direction outwardly in a concave manner, forming an inward-projecting material thickening into the base such that the inward-projecting material thickening protrudes inwardly with respect to the base along the longitudinal direction and forming an opening in the area of the inward-projecting material thickening, in such a manner that the inward-projecting collar is provided by at least a part of the inward-projecting material thickening.

2. The method according to claim 1, wherein the necking-in step is carried out through several pivoting movements of the forming roller along different pivot curves in each of the pivoting movements.

3. The method according to claim 1, wherein the base is closed through the necking-in step prior to the formation of the opening.

4. The method according to claim 3, wherein after closing the base, said base is formed in order to provide and/or shape the inward-projecting material thickening.

5. The method according to claim 1, wherein to provide the inward-projecting material thickening material is shifted from an external area of the pipe section and/or the base to a central area of the base.

6. The method according to claim 1, wherein the inward-projecting material thickening is produced at least partially during the necking-in step.

7. The method according to claim 1, wherein initially an outward-projecting material thickening is formed and subsequently the outward-projecting material thickening is formed into the inward-projecting material thickening.

8. The method according to claim 7, wherein the forming of the outward-projecting material thickening into the inward-projecting material thickening is effected through an axial feeding of a forming tool.

9. The method according to claim 1, wherein material is accumulated in the area of the inward-projecting material thickening by stamping the base from the outside.

10. The method according to claim 1, wherein during the necking in step the forming roller is positioned perpendicularly to the workpiece contour of the pipe section to be formed.

11. The method according to claim 1, wherein the opening is introduced by means of a cutting method.

12. The method according to claim 1, wherein the opening is introduced through displacement drilling.

13. The method according to claim 1, wherein to provide the pipe section a circular blank is used, on which a further collar with a further opening is designed, and the circular blank is set into rotation and, for the purpose of providing the pipe section, an outer circumference of the circular blank is formed axially against a spinning chuck towards a side, to which the further collar is directed.

14. The method according to claim 13, wherein the further collar is designed on the circular blank through spinning/flow forming.

* * * * *